US007513303B2

(12) United States Patent
Hern

(10) Patent No.: US 7,513,303 B2
(45) Date of Patent: Apr. 7, 2009

(54) WELLBORE CLEANUP TOOL

(75) Inventor: Gregory L. Hern, Huffman, TX (US)

(73) Assignee: BAker Hughes Incorporated, Houston, TX (US)

( * ) Notice: Subject to any disclaimer, the term of this patent is extended or adjusted under 35 U.S.C. 154(b) by 222 days.

(21) Appl. No.: 11/513,997

(22) Filed: Aug. 31, 2006

(65) Prior Publication Data

US 2008/0053651 A1 Mar. 6, 2008

(51) Int. Cl.
*E21B 37/00* (2006.01)
*E21B 31/08* (2006.01)

(52) U.S. Cl. ..... 166/173; 166/99; 166/205

(58) Field of Classification Search ..... 166/311, 166/312, 170, 173, 99, 205
See application file for complete search history.

(56) References Cited

U.S. PATENT DOCUMENTS 4,515,212 A 5/1985 Krugh
5,330,003 A 7/1994 Bullick
6,464,010 B1 * 10/2002 Brown ..... 166/311
6,607,031 B2 8/2003 Lynde et al.
6,776,231 B2 * 8/2004 Allen ..... 166/173
2004/0094302 A1 * 5/2004 Booth ..... 166/311

FOREIGN PATENT DOCUMENTS

GB 2335218 A 9/1999
GB 2335687 A 9/1999

OTHER PUBLICATIONS

Baker Hughes, Baker Oil Tools, 9-⅝" and 10-¾" Multi-Task Wellbore Filter, May 16, 2005, 1 page.
Baker Hughes, Baker Oil Tools, 7" and 7-⅝" Multi-Task Wellbore Filter, Jul. 14, 2005, 1 page.

* cited by examiner

*Primary Examiner*—Hoang Dang
*Assistant Examiner*—Elizabeth C Gottlieb
(74) *Attorney, Agent, or Firm*—Steve Rosenblatt

(57) ABSTRACT

A wellbore cleanup tool features a flow diverter that comprises a series of bristles mounted on a sleeve that slides on a spiral track on a mandrel. For run in the sleeve is in an upper position with respect to the mandrel and allows flow around the outside of the screen and through passages defined between the sleeve and the mandrel. When coming out of the hole, the sleeve shifts down and the bristles block flow through themselves so as to direct the debris laden fluid under the sleeve that now rests on top of the screen. The defined flow path is under the sleeve and behind the screen leaving the debris trapped and allowing the fluid to pass through the screen without the debris.

15 Claims, 1 Drawing Sheet

WELLBORE CLEANUP TOOL

FIELD OF THE INVENTION

The field of this invention is downhole cleanup of casing and liners and more particularly after cementing and before completion.

BACKGROUND OF THE INVENTION

The cementing process is known to leave debris such as cement lumps, rocks, and congealed mud in the casing or liner. Other debris can be suspended in the mud and it can include oxidation lumps scale, slivers, shavings and burrs. A variety of well cleaning tools have been developed particularly to dislodge such debris from the casing or liner walls. Jet tools are used to blow such debris loose. A variety of casing scrapers and brushes have been developed to accomplish the same purpose. These tools have more recently been combined with additional tools to filter the downhole fluid and capture the debris therein for removal to the surface.

One such debris filtering tool is described in UK Application 2 335 687 and is called the Well Patroller, a trademark of the owner Specialised Petroleum Services of Aberdeen, Scotland. This device generally features a wiper cup that rides the inside of the casing. The cup prevents flow around a mandrel. As the tool is lowered, flow is directed through a plurality of ball check valves into an annular space behind a screen and out though the center of the cup and around the mandrel. In this embodiment, no filtration occurs as the tool is inserted and the cup wipes the casing wall. When the tool is brought out of the wellbore, the ball check valves close and fluid above the cup is directed to the annular space inside the filter and out through the filter. The annular space acts as a reservoir for debris retained by the filter. If the filter clogs pressure can be built up to blow a bypass rupture disc, or, in some embodiments to simply shear screws and blow the cup off the mandrel. There are shortcomings in this design. The most significant is that the opening size in the check valves is small and is prone to plugging with debris. When running in the Well Patroller, downhole progress is stopped every 90 feet or so as another stand of tubulars is added at the surface. During these times the fluid flow through the tool stops and debris suspended in the fluid will settle to the bottom of the tool. The debris will eventually accumulate to the point which the ball check valves can not open. Once fluid can not pass though the check valves, the annular restriction at the top of the tool will force the annular fluid to pass through the screen. Any debris in the fluid will not be able to pass through the screen. When the tool is pulled out of the well, the debris will be left in the well. The Well Patroller tool is used in conjunction with a separate tool to scrape debris off the inside casing wall. The wiper cup's purpose, in this tool, is to divert flow as opposed to scraping the inner casing wall.

Other debris removal tools are shown in UK Application 2 335 218; U.S. Pat. Nos. 4,515,212 and 5,330,003. The tool in UK Application 2 335 218 requires forced circulation through a plurality of eductors coupled with a deflector for the induced flow to encourage solids to drop into an annular space. Boot baskets, such as those made by Tri-State Oil Tools Industries Inc., now a part of Baker Hughes Incorporated featured an annular space defined between a solid basket and a mandrel. Solids were capable of being captured on the trip downhole solely due to the velocity decrease as the flow emerged above the boot so that solids could drop into the annular space between the mandrel and the boot. Since the boot was solid, no meaningful capture of solids occurred on the trip out of the hole.

The device in U.S. Pat. No. 6,607,031 seeks to eliminate or, at least minimize, the shortcomings of the Well Patroller device and the other tools previously used to filter downhole debris. It provides an improved open area in the valving to reduce the potential problems from plugging. It has a retractable flow diverter which allows rapid insertion into the wellbore, and provides easy passage of suspended debris past the tool. It improves the valve structure to get away from spring loaded balls which can create maintenance concerns. This design uses a cup seal as a flow diverter that can be subjected to tearing while in service. It further depends on an internal valving system that can get clogged with debris that passes through it.

The present invention offers a more durable design that features an array of brushes that act to clean the wellbore wall of debris when moved in one direction in the well and still function as an effective flow diverter despite the spacing between the bristles. The design features the diverter movably mounted on a sleeve to a mandrel and obtains the proper flow configuration by the sliding motion of the sleeve.

These and other advantages of the present invention will be more readily apparent to those skilled in the art from a review of the preferred embodiment which appears below.

SUMMARY OF THE INVENTION

A wellbore cleanup tool features a flow diverter that comprises a series of bristles mounted on a sleeve that slides on a spiral track on a mandrel. For run in the sleeve is in an upper position with respect to the mandrel and allows flow around the outside of the screen and through passages defined between the sleeve and the mandrel. When coming out of the hole, the sleeve shifts down and the bristles block flow through themselves so as to direct the debris laden fluid under the sleeve that now rests on top of the screen. The defined flow path is under the sleeve and behind the screen leaving the debris trapped and allowing the fluid to pass through the screen without the debris.

DETAILED DESCRIPTION OF THE PREFERRED EMBODIMENT

Figure 1:
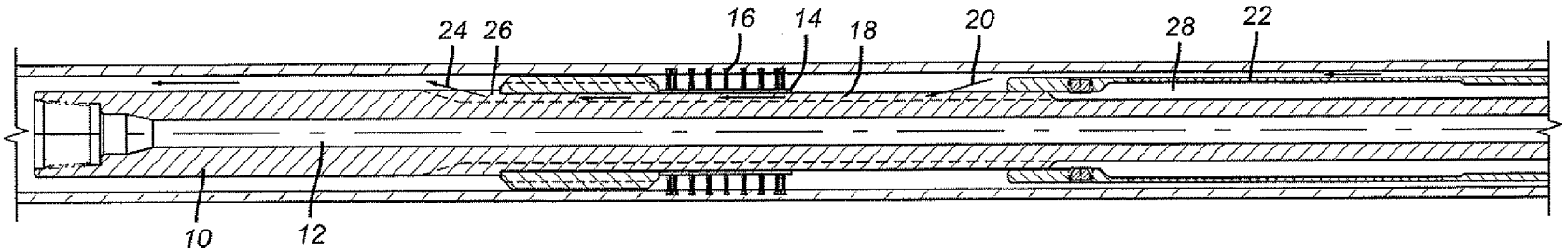
FIG. 1 shows the tool in section when run into the well.

FIG. 1 illustrates the tool in the run in position. It has a mandrel 10 with a passage 12 running through it. A sleeve 14 supports bristles 16 and is slidably mounted to the mandrel 10. A passage 18 is defined between the sleeve 14 and the mandrel 10. For run in, the well fluid forces the sleeve 14 up relative to the downward direction of motion of the mandrel 10, as shown in FIG. 1. Arrow 20 represents well fluid with debris entering passage 18 as the mandrel 10 is run into the hole. The debris laden fluid simply bypasses a screen 22 as it passes under the bristles in passage 18 and makes an exit above them as illustrated by arrow 24. In the FIG. 1 position, the upward motion of sleeve 18 is stopped at a location that leaves passage 18 open at opposed ends. Going in the hole, the bristles 16 scrape the casing or liner wall to dislodge any debris that has adhered to it. As the tool descends, the loosened debris gets above the bristles 16 through the open on both ends passage 18. Passage 18 is maintained by a plurality of baffles 26 that preferably extend radially in a generally spiral pattern and are preferably equally spaced. Baffles 26 keep the sleeve fully centralized and supported off of mandrel 10 as it shifts between the positions shown in FIGS. 1 and 2. Preferably, passage 18 is open to an annular space 28 below it that is located between the mandrel 10 and the screen 22. The velocity of the downhole advance of the tool is usually sufficient to keep the debris laden fluid moving up through passage 18 as indicated by arrows 20 and 24. However, if the tool velocity slows enough to allow debris to settle as the tool goes down the hole, such debris would settle into annular space 28, which is where debris is ultimately captured on the trip out of the wellbore.

Figure 2:
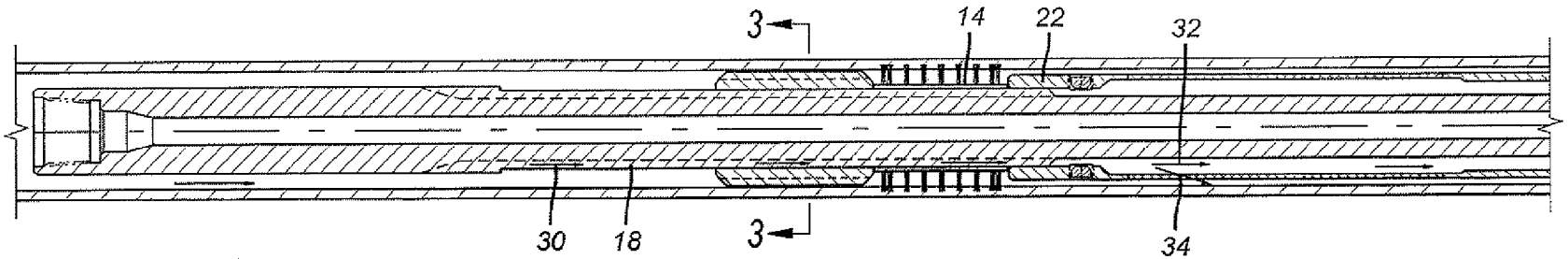
FIG. 2 is the view of FIG. 1 with the tool coming out of the well.
Figure 3:
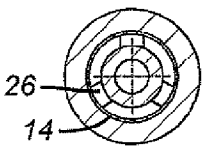
FIG. 3 is the view along lines 3-3 of FIG. 2.

When coming out of the wellbore, the well fluid pushes down sleeve 14 until it butts up against screen 22, as shown in FIG. 2. In this position the passage 18 is open at the top to accept debris laden fluid as the tool is run out of the hole. Arrow 30 shows the debris laden fluid entering passage 18. Once the debris laden fluid enters passage 18 it cannot get out laterally. Since sleeve 14 is against screen 22 the continuation of passage 18 is only into annular space 28. There the debris is captured while the fluid runs through the screen 22. Arrow 32 shows the debris settling in the annular space 28 and arrow 34 shows the fluid without debris going through the screen 22.

While the preferred embodiment illustrates filtration when coming out of the hole, the components described can be configured for filtration going into the hole. The bristles 16 despite the gaps among them still act as a flow diverter in the FIG. 2 position. This is because the debris in the fluid builds on the bristles 16 as the tool comes out of the hole to the point where most if not all the fluid above the bristles 16 as the tool comes out of the hole become the flow stream represented by arrow 30. Alternatively, the bristles 16 can be so densely packed so that they act as a flow obstruction without the above mentioned debris accumulation. Although bristles are illustrated, other materials that provide some scraping action of the wellbore during movement of the tool in at least one direction can also be used. The bristles 16 are flexible and durable to withstand the harsh environments downhole. Alternatively, a rubber cup can be used instead or in combination with the bristles 16.

The design is far simpler than earlier efforts such as illustrated in U.S. Pat. No. 6,607,031 as the internal valving feature of that design is eliminated and the flow diverter design is more durable and surface scraping of debris is more efficient.

While the sleeve 14 is preferably not rotationally locked to the mandrel 10, the baffles 26 can be used to either rotationally lock the sleeve 14 as it shifts up and down (if they are oriented longitudinally) or to impart a rotation to it as it moves axially for an additional scrubbing effect with the bristles 16 if they are spirally disposed. The bristles 16 can be in longitudinal rows with gaps in between or they can be in different patterns or randomly disposed just as long as they can capture debris sufficiently to divert flow into passage 18.

The above description is illustrative of the preferred embodiment and many modifications may be made by those skilled in the art without departing from the invention whose scope is to be determined from the literal and equivalent scope of the claims below.

I claim:

1. A wellbore cleanup tool, comprising:

a mandrel;

a screen mounted to said mandrel defining a first annularly shaped volume in between for trapping debris, said first annularly shaped volume remaining open on an upper end thereof for collection of debris regardless of direction of mandrel movement;

a flow diverter movably mounted to said mandrel above said screen for movement away from said screen when said mandrel is moved in a first direction and for movement against said screen when said mandrel is moved in a second direction opposite said first direction;

said flow diverter, when moved away from said screen providing a path for debris laden fluid that extends from outside said screen to between said diverter and the top of said screen and continues in a second annularly shaped volume between said diverter and said mandrel, said second annularly shaped volume is aligned and spaced and not isolated from said first annularly shaped volume, said second annularly shaped volume is also not isolated when said flow diverter is against said screen.

2. The tool of claim 1, wherein:

said flow diverter, when moved against said screen creates a second path for debris laden fluid into said annularly shaped volumes that now abut each other.

3. The tool of claim 2, wherein:

said flow diverter is mounted to a centralizing structure on said mandrel.

4. The tool of claim 3, wherein:

said flow diverter can rotate relatively to said mandrel.

5. The tool of claim 4, wherein:

said flow diverter comprises a sleeve supporting a plurality of bristles.

6. The tool of claim 3, wherein:

said centralizing structure comprises spirally extending members mounted to said mandrel.

7. The tool of claim 6, wherein:

said mandrel comprises a bore therethrough.

8. The tool of claim 5, wherein:

said bristles span to the wellbore wall and trap debris in gaps between them so as to be able to better divert flow into said second annularly shaped volume.

9. A wellbore cleanup tool, comprising:

a mandrel;

a screen around said mandrel defining an annular catch volume for debris and having an upper and a lower end;

a diverter having an upper end and a lower end closer to said screen and defining a passage between itself and said mandrel and movably mounted with respect to said mandrel toward and away from the top of said screen, said diverter opening and closing said passage, near its lower end, when its lower end is disposed respectively away from and adjacent said screen;

said passage remaining open to said catch volume when said diverter is away from and adjacent said screen.

10. The tool of claim 9, wherein:

said passage and said catch volume are aligned.

11. The tool of claim 9, wherein:

said diverter is centralized on said mandrel.

12. The tool of claim 9, wherein:

said diverter can rotate relatively to said mandrel.

13. The tool of claim 11, wherein:

said mandrel comprises spirally wound support members to centralize said diverter.

14. The tool of claim 9, wherein:

said diverter comprises a sleeve supporting a plurality of bristles.

15. A wellbore cleanup tool, comprising:

a mandrel;

a screen around said mandrel defining an annular catch volume for debris and having an upper and a lower end;

a diverter having an upper end and a lower end closer to said screen and defining a passage between itself and said mandrel and movably mounted with respect to said mandrel toward and away from the top of said screen, said diverter opening and closing said passage, near its lower end, when its lower end is disposed respectively away from and adjacent said screen;

said passage remaining open to said catch volume when said diverter is away from and adjacent said screen;

said diverter can move to contact the top of said screen.

* * * * *